US007434530B2

(12) United States Patent
Chen

(10) Patent No.: US 7,434,530 B2
(45) Date of Patent: Oct. 14, 2008

(54) COLLAPSIBLE SELF PROPELLED HYDROFOIL DEVICE

(76) Inventor: Shane Chen, 1821 NW. Eight Ave., Camas, WA (US) 98607

( * ) Notice: Subject to any disclaimer, the term of this patent is extended or adjusted under 35 U.S.C. 154(b) by 0 days.

(21) Appl. No.: 11/375,538

(22) Filed: Mar. 13, 2006

(65) Prior Publication Data

US 2006/0191462 A1 Aug. 31, 2006

Related U.S. Application Data

(63) Continuation-in-part of application No. 10/657,664, filed on Sep. 7, 2003, now Pat. No. 7,021,232.

(51) Int. Cl.
*B63B 1/24* (2006.01)

(52) U.S. Cl. ..... 114/274; 440/21

(58) Field of Classification Search ..... 114/274–282, 114/354; 440/21
See application file for complete search history.

(56) References Cited

U.S. PATENT DOCUMENTS

| | | | | |
|---|---|---|---|---|
| 909,468 | A * | 1/1909 | Simpson | 114/280 |
| 3,105,249 | A * | 10/1963 | Palmore | 441/65 |
| 6,099,369 | A * | 8/2000 | Puzey | 440/21 |

* cited by examiner

*Primary Examiner*—Ed Swinehart
(74) *Attorney, Agent, or Firm*—Steven J. Adamson, PC

(57) ABSTRACT

A collapsible or compactable hydrofoil device having front and rear foils, a support structure and a steering mechanism that may be collapsed into a compact size for transport and storage. The steering mechanism includes several releasably coupled components that are in turn coupled to a drive platform and drive foil. The drive platform may be configured in a plurality of embodiments that each achieve ready disassembly and reassembly. The drive foil may be configured of multiple releasably couplable sections.

19 Claims, 6 Drawing Sheets

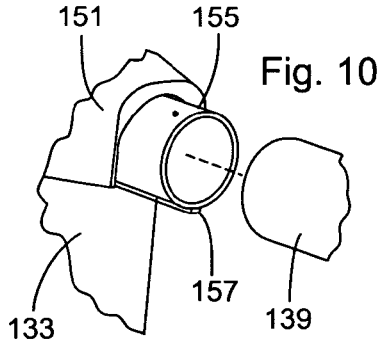
Fig. 10
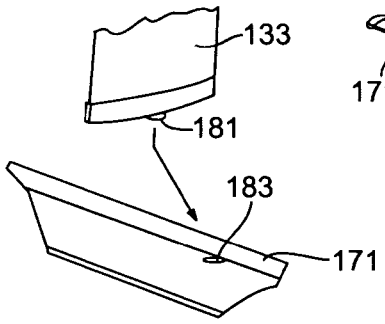
Fig. 11
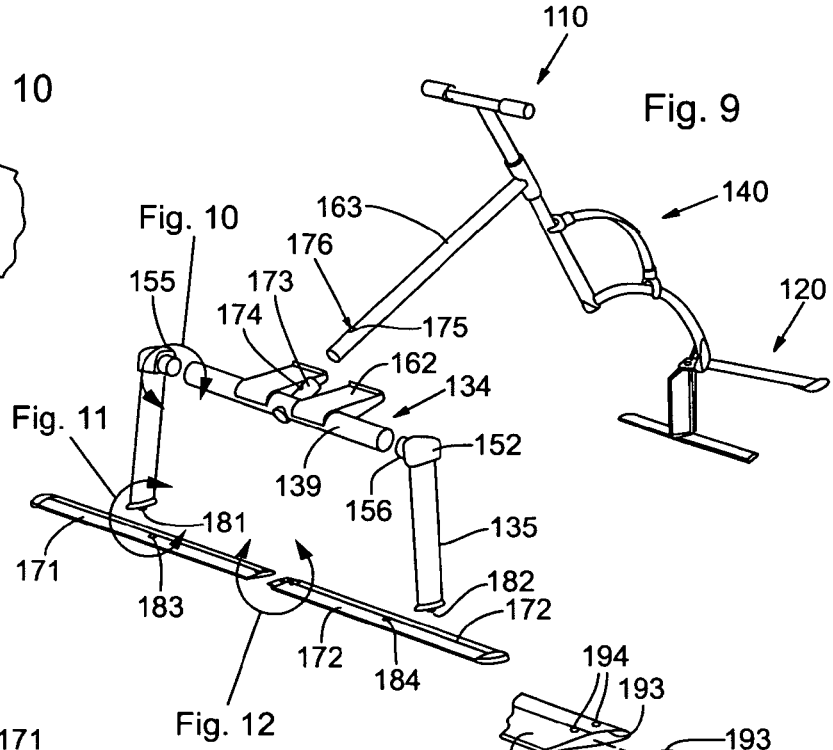
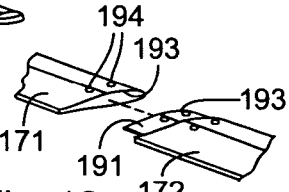
Fig. 12

COLLAPSIBLE SELF PROPELLED HYDROFOIL DEVICE

CROSS REFERENCE TO RELATED APPLICATIONS

This application is a continuation-in-part of U.S. patent application Ser. No. 10/657,664, filed Sep. 7, 2003, and having the same inventor as above and entitled "Self Propelled Hydrofoil Device," now issued as U.S. Pat. No. 7,021,232.

FIELD OF THE INVENTION

The present invention relates to hydrofoil devices and, more specifically, to hydrofoil devices that may be configured for self propelled operation and are compactable for ease of transport and storage.

BACKGROUND OF THE INVENTION

Relevant prior art hydrofoil devices include the "Trampofoil" device disclosed in Swedish Design Patent no. 98-0088 and a Water Vehicle disclosed in U.S. Pat. No. 6,099,369 issued to Puzey.

The Trampofoil discloses a basic self-propelled hydrofoil device having a main foil in the rear and a steerable foil in the front. The '369 patent issued to Puzey discloses a related device that has a biased pivot point located substantially above the rear foil, i.e., under the area at which a user stands when in use (FIG. 9, item 82, or FIG. 10, item 72).

Disadvantageous aspects of the Trampofoil device and the '369 patent include that they may not permit the front edge of the rear or "drive" foil to tilt sufficiently downward in response to a driving leg thrust to adequately propel the craft forward. A significant amount of the downward leg force may thus be impaled upon the foil, rather than shearing through water - wasting significant driving energy. In addition, the steering shaft of the Trampofoil is made of fiberglass which bends not only in the direction of travel, but also laterally, making steering difficult.

Due to these and other disadvantageous aspects, the arrangement of the Trampofoil and that of the '369 patent are difficult to use, particularly by lay persons.

A need thus exists for a hydrofoil device that may be configured for self-propelled operation and is relatively easy to use. A need also exists for a hydrofoil device that provides sufficient forward thrust for the energy expended by the downward thrust of an operators leg's (or other means).

In addition, the arrangements of the Trampofoil and the '369 patent are bulky and not collapsible. This negatively impacts transport and storage and accessibility for use. For example, either a special large capacity vehicle is required for their transport, or they are assembled in place and remain there. Storage opportunities are also negatively impacted by the large unweilding configuration of these devices.

A need exist for a hydrofoil device that can be readily collapsed or compacted for easy transport and/or storage.

SUMMARY OF THE INVENTION

Accordingly, the present invention is directed towards providing a hydrofoil device that provides ready forward movement in response to driving thrusts or a related force.

The present invention is further directed towards providing a hydrofoil device that is collapsible or compactable for ready transport and storage.

These and related objects of the present invention are achieved by use of a self-propelled hydrofoil device as described herein.

In one embodiment of the present invention, one or more of the steering mechanism, operator platform and foils are collapsible, and preferably all are to render a compact size.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIG. 9 is a perspective view of another embodiment of a hydrofoil device in accordance with the present invention that achieves a compact size.

FIGS. 10-12 are perspective views that illustrate assembly details for the hydrofoil devices of FIGS. 8 and 9.

DETAILED DESCRIPTION

Figure 1:
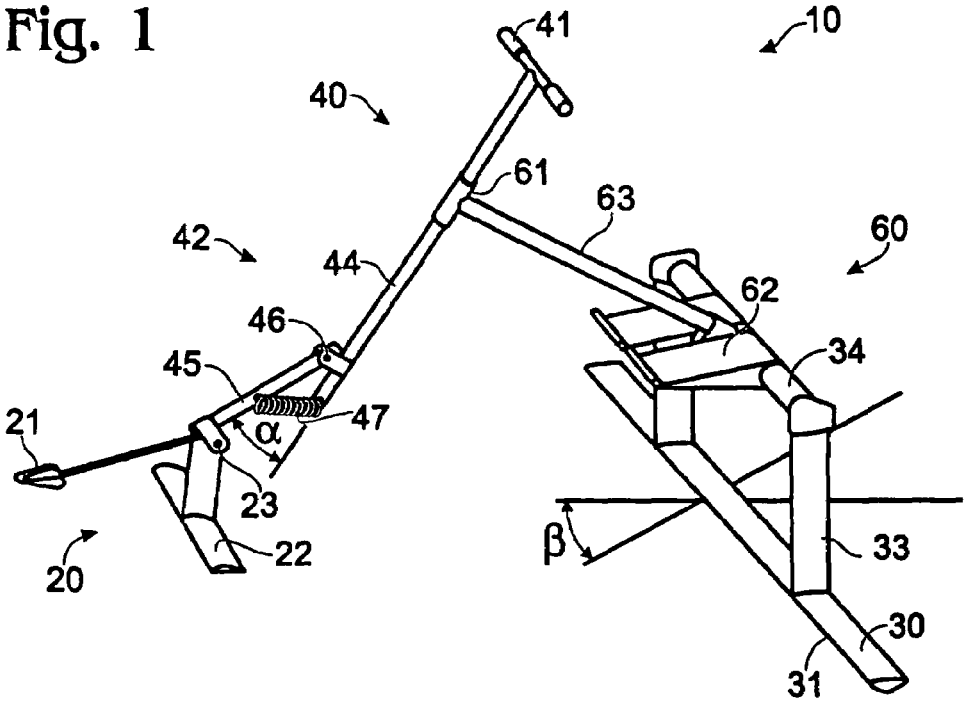
FIG. 1 is a perspective view of a hydrofoil device 10 in accordance with the present invention.

Referring to FIG. 1, a perspective view of a hydrofoil device 10 in accordance with the present invention is shown. Hydrofoil device 10 may include a forward located canard arrangement 20 and a rear or aft located drive foil 30.

The canard 20 may include a plate or spoon 21 (which tracks the water surface) and a foil member 22, or be otherwise arranged. The primary function of the canard is finding and locking onto the water surface and canards and like devices are known in the art.

The principal or drive foil 30 may be one of any suitable hydrofoil "wings" or "foils." Such foils are known in the art. Drive foil 30 may be fixedly coupled to vertical members 33 which may be fixedly coupled to support bar 34. Drive platform 60 is preferably configured to receive a standing human and may include two foot placement plates 62 or be otherwise arranged. Plates 62 are preferably fixedly coupled to bar 34 so that a downward thrust on the plates translates to a similar downward force asserted on foil 30. Note that the plates may be located on the inside edge of support bar 34 such that the substantially downward thrust is first applied to the leading edge 31 of foil 30.

The steering mechanism 40 may include a steering handle 41 coupled to a steering shaft 42 that is provided in sleeve 61. The distal end of the shaft is pivotally coupled to canard 20 at pivot 23. The steering mechanism is preferably coupled to the drive platform via a support shaft 63 and associated sleeve 61. The support shaft and sleeve may be securely coupled to the drive platform, for example, to support bar 34.

Shaft 42 preferably includes an upper section 44 and a lower section 45 that are coupled in such a manner that they may pivot or otherwise move relative to one another in such a manner as to achieve a downward tilt in the front edge 31 of drive foil 30.

FIG. 1 illustrates upper and lower steering shaft sections 44, 45 jointed at pivot 46 and bias into a given position by bias spring 47. The relative movement of the two sections about pivot 46, indicated as angle α, achieves a similar movement in the angle of attack, β, of leading edge 31 of foil 30. Increases in α and thus β correspond to a more aggressive cutting of foil 30 into the water, thereby propelling hydrofoil device 10 forward.

As the thrust of a user is spent, the force of bias spring 47 causes upper and lower sections 44, 45 to move towards their "rest position," i.e., into closer alignment, thereby decreasing both α and β and ultimately causing leading edge 31 of foil 30 to move upward placing foil 30 back in position for another downward, forward propelling thrust.

Figure 2:
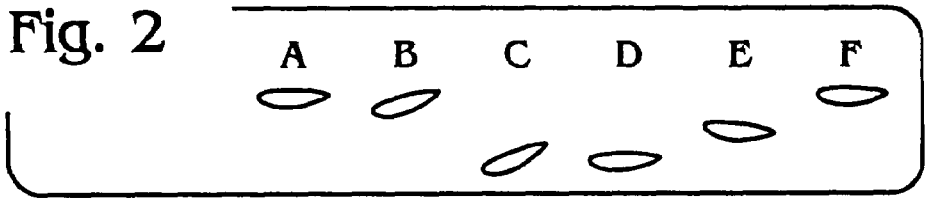
FIG. 2 is a diagram of relative drive foil position during use.

Referring to FIG. 2, a diagram of relative drive foil position during use is shown. Position A is a glide or "steady-state" position as the foil glides through the water. Prior to a leg thrust a user preferably pushes on steering handle 41. This causes upper and lower sections 44, 45 to move apart, i.e., out of alignment, increasing α (and β) and causing leading edge 31 to tip downward (Position B). The user then asserts a leg thrust on platform 60 causing tip 31 to descend further and causing the entire foil to descend into the fluid medium at an angle, pushing the craft forward against the resistance of the water. The position of foil 30 at this stage is shown in Position C. As the thrust expires, the force of the bias spring begins to reduce α and β, causing the leading edge to begin to rise and the foil to pass through a substantially steady state position, but further submerged than in Position A (Position D). The leading edge then rises slightly (due in part to the surface finding properties of the canard) causing the foil to rise (Position E) and return to its steady-state position (Position F, and Position A), ready for the next thrust.

Note that while the upper and lower sections 44, 45 are preferably moveable in a first dimension to facilitate a desired movement of leading edge 31, they are sufficiently rigid from side to side or in a "steering dimension" to provide adequate steering.

Referring to FIGS. 3-7, other embodiments of a hydrofoil device in accordance with the present invention are shown. The devices illustrated in these figures are intended to illustrate aspects of the breadth of the present invention and in no way to limit the present invention to the illustrated embodiments.

Figure 3:
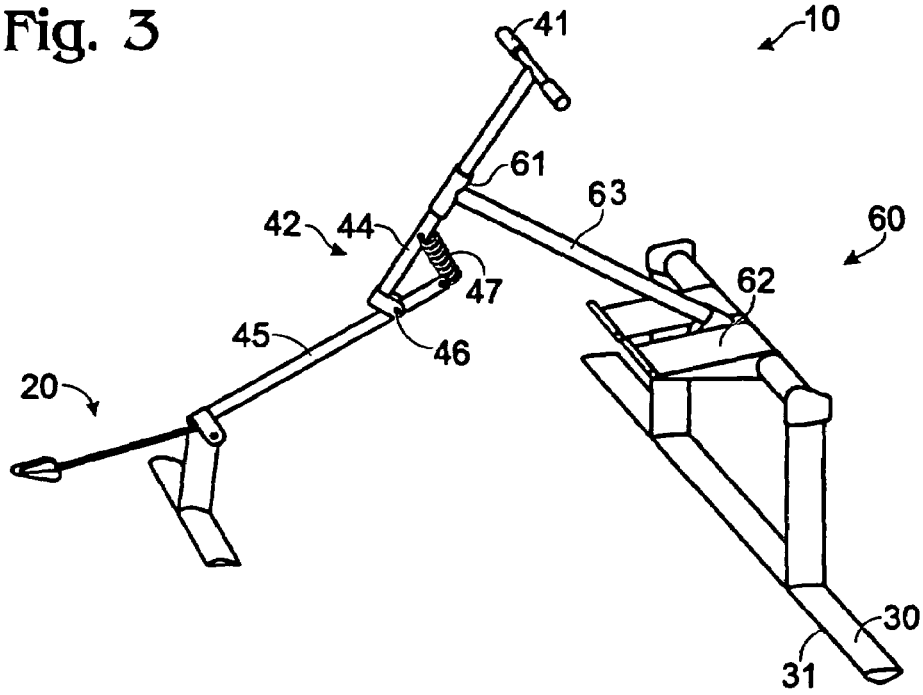
FIGS. 3-7 are perspective views of other embodiments of a hydrofoil device in accordance with the present invention.

FIG. 3 illustrates device 10, but with a pivot arrangement in steering shaft 42 that is different from that shown in FIG. 1. In the embodiment of FIG. 1, the upper section 44 extends past pivot 46. In the embodiment of FIG. 3, the lower section 45 extends past pivot 46. Bias spring 47 in both the embodiments of FIGS. 1 and 3 may be an expansion spring or other suitable means.

Figure 4B:
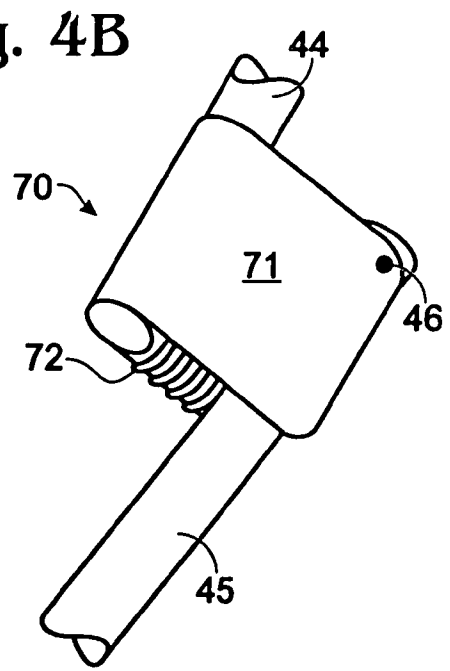
Figure 4A:
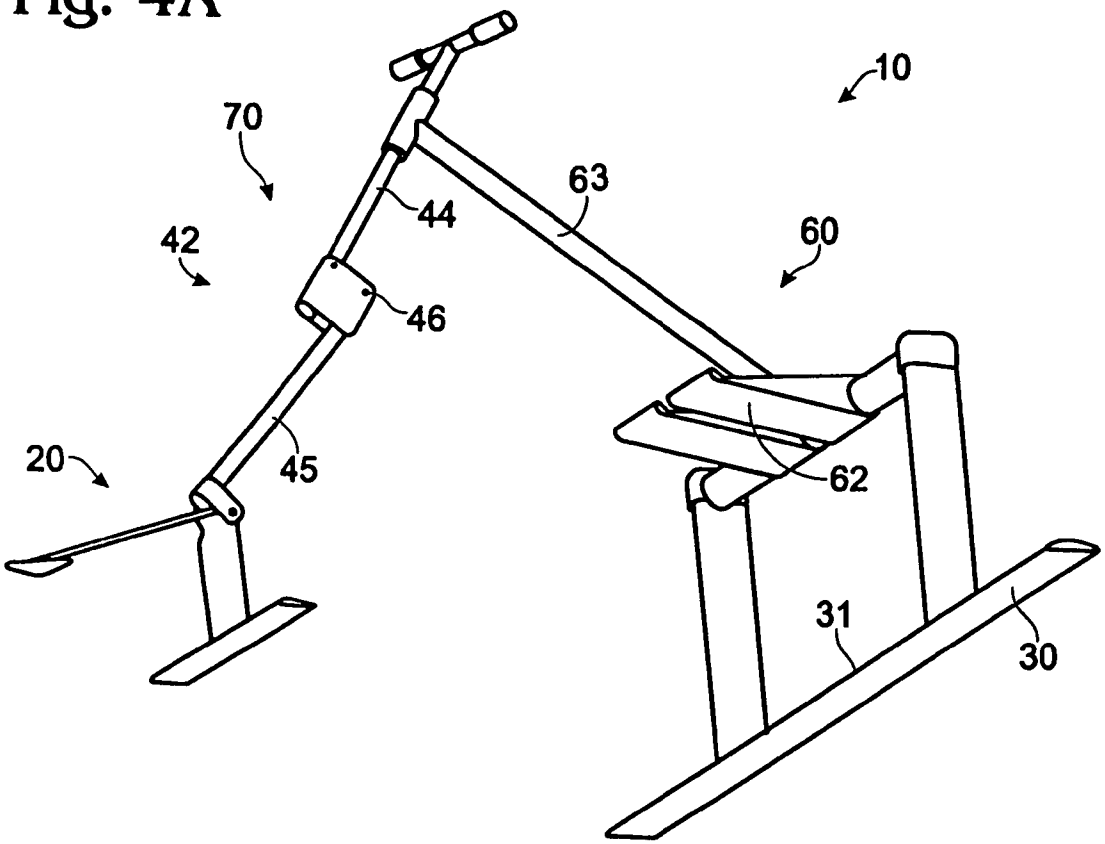

FIG. 4A illustrates a perspective view (from below horizontal) of hydrofoil device 10 having a compression spring based pivot mechanism 70 in steering shaft 42. FIG. 4B illustrates a close-up perspective view of the compression spring based pivot mechanism 70. The embodiment of FIGS. 4A-4B provide a coupling member 71 that couples upper section 44 to lower section 45 via pivot 46. A compression spring 72 is provided between the upper and lower sections 44, 45 and adjacent pivot 46 such that it compresses in a manner that increases α and β and expands in a manner that decreases these two angles, such that foil 30 functions as discussed above.

Figure 5:
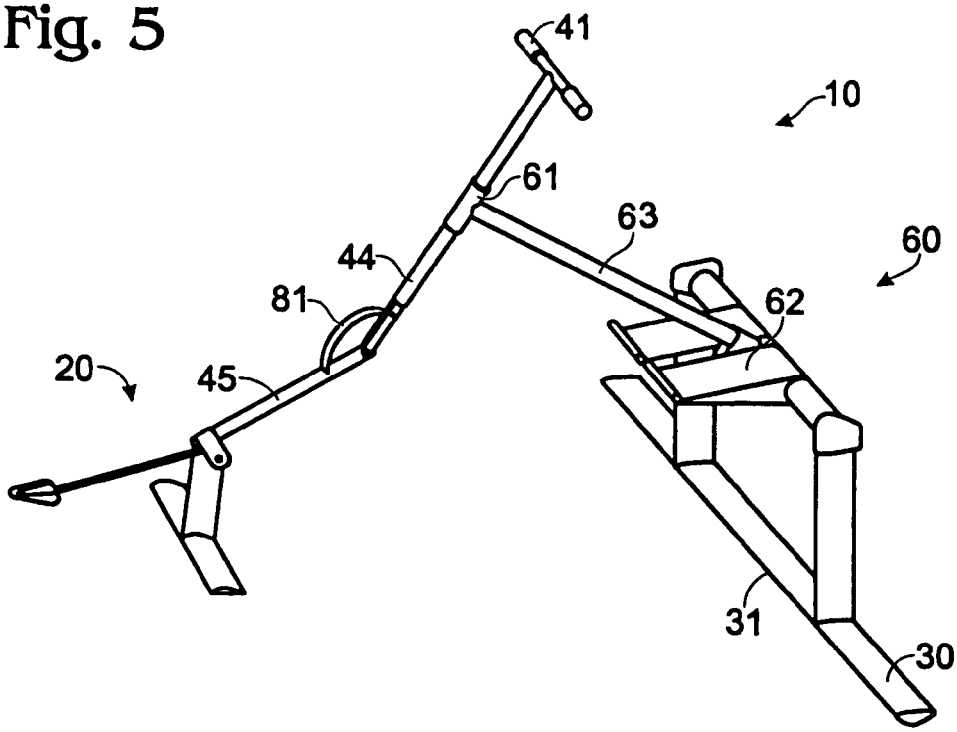

FIG. 5 illustrates hydrofoil device 10, albeit with a leaf spring type mechanism 81 coupled to pivotally connected sections 44, 45. The leaf spring 81 may be made of steel or fiberglass or other suitable material. It may be formed with loops at both ends which are then coupled to the respective shaft sections 44, 45 by mounting pins. Other mounting mechanisms may be used. Spring 81 functions in a manner similar to compression spring 72.

Figure 6:
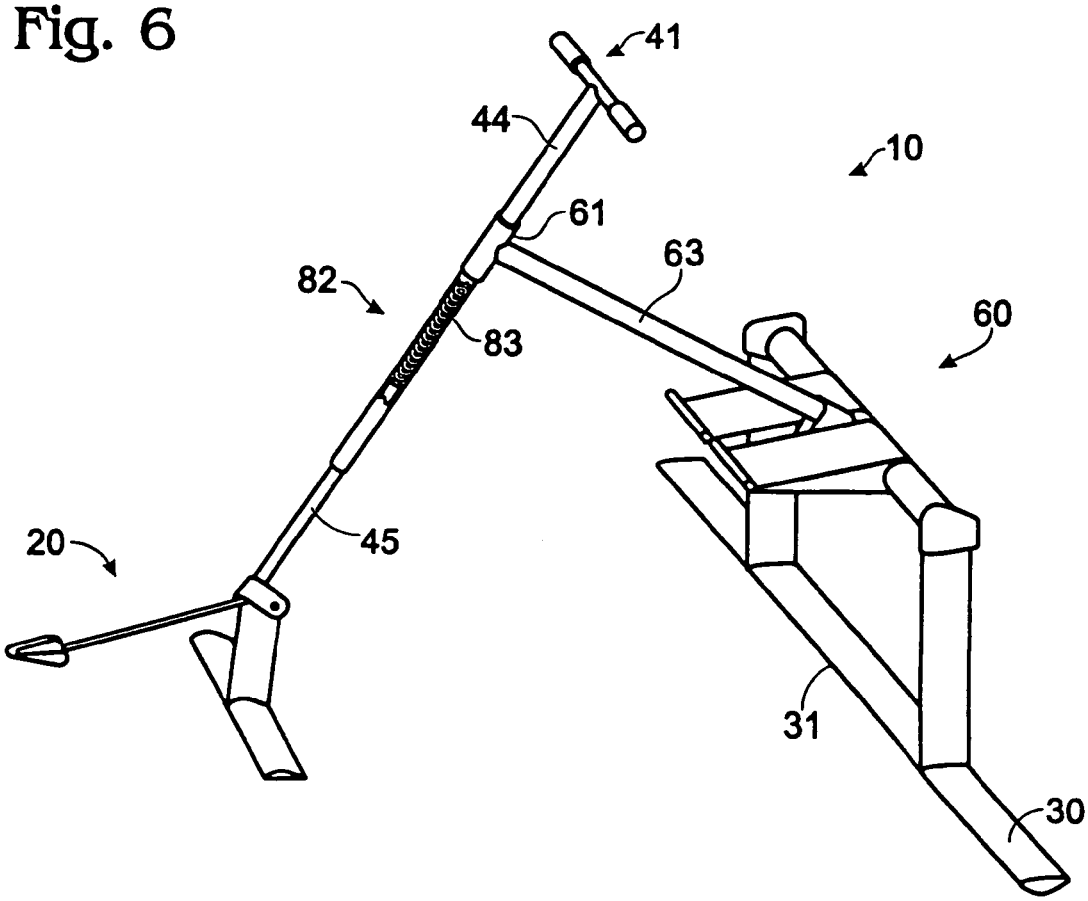

FIG. 6 illustrate hydrofoil device 10, albeit with a linear coil spring 82 coupled between shaft sections 44, 45. A support shaft 83 is provided internal to the coil spring and the lower end of support shaft 83 descends into lower section 45. In use, coil spring 82 is compressed when a user pushes down on handle 41 and thrusts his or her leg downward on platform 60. The leg thrust on platform 60 drives the front end 31 of foil 30 downward propelling the craft forward and subsequent expansion of spring 82 pulls foil front end 31 back up through positions D and E to Position F (see FIG. 2).

Figure 7:
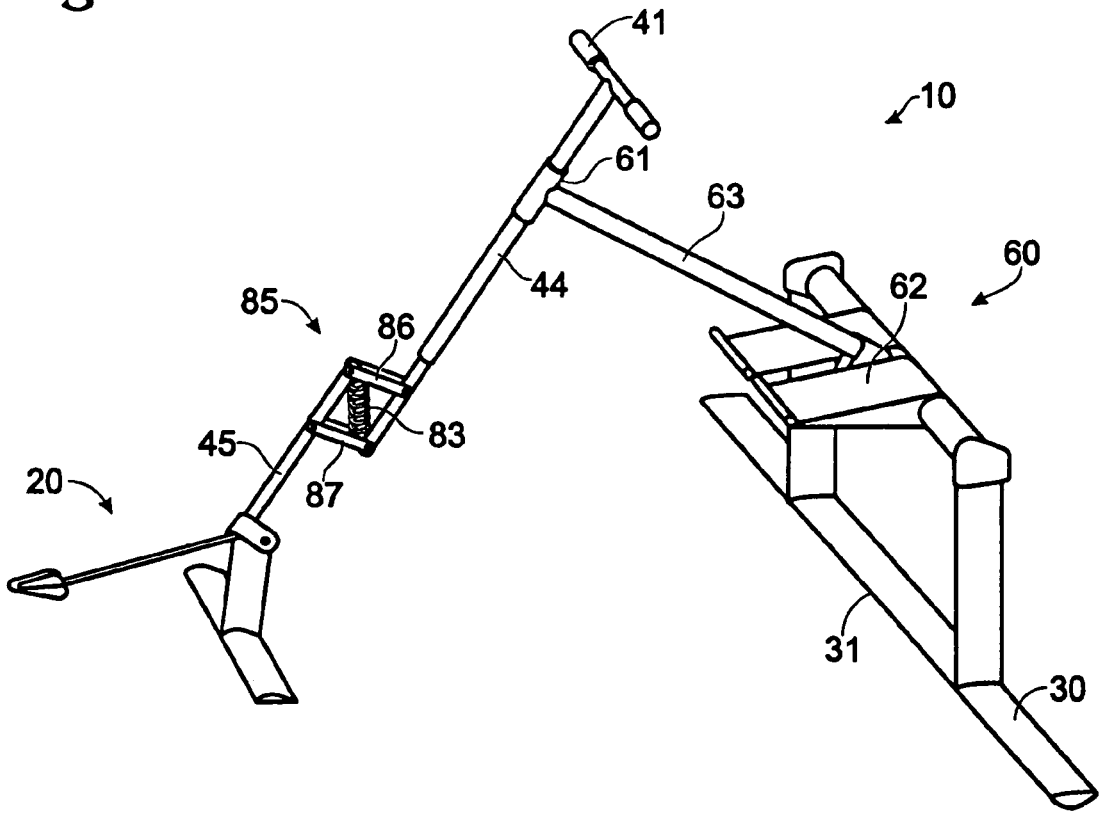

FIG. 7 illustrates hydrofoil device 10, albeit with a parallelogram or like coupling mechanism 85. Mechanism 85 may include two cross-coupling members 86, 87 and a spring or other bias member 88. The device of FIG. 7 operates in a manner similar to that described in FIG. 6 (with the two steering shaft sections 44, 45 toward or away from one another) and as elsewhere described herein.

Figure 8:
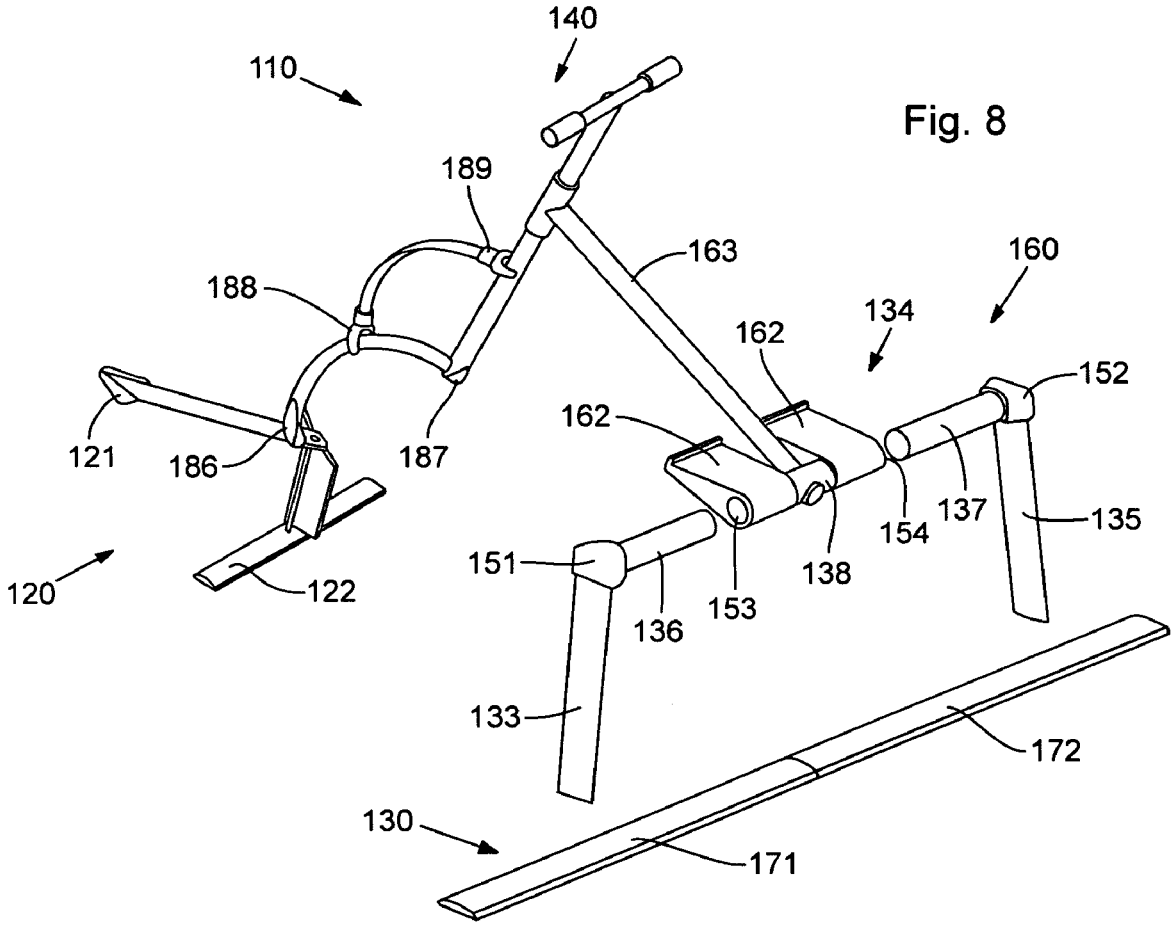
FIG. 8 is a perspective view of an embodiment of a hydrofoil device in accordance with the present invention that achieves a compact size.

Referring to FIG. 8, a perspective view of an embodiment of a collapsible hydrofoil device 110 in accordance with the present invention is shown. Hydrofoil device 110 may include a forward located canard arrangement 120 and a rear or aft located drive foil 130.

The canard 120 may include a plate or spoon 121 (which tracks the water surface) and a foil member 122, or be otherwise arranged. The canard preferably functions in a similar manner to canard 20 discussed above.

A steering mechanism 140 is preferably provided similar to steering mechanism 40 of FIG. 1. The steering mechanism 140 may include a steering handle 141 coupled to a steering shaft 142 that is provided in sleeve 161. The distal end of the shaft is pivotally coupled to canard 120 at pivot 123. The steering mechanism is preferably coupled to a drive platform 160 via a support shaft or similar structure 163 which is coupled to sleeve 161.

Shaft 142 preferably includes an upper section 144 and a lower section 145 that function similar to upper and lower sections 44, 45 of shaft 42. In the embodiment of FIG. 8, the lower section 145 is curved and a curved leaf spring 147 is provided for biasing the shaft sections towards a desired position (recovery position).

A plurality of releasable pins or other releasable fastening mechanism 186-189 may be provided at the various joints of steering mechanism 140 to permit releasable attachment of the respective members to one another.

Drive platform 160 is preferably coupled to the support shaft 163 and the drive foil 30 in a manner that permits collapsibility or ready disassembly of the drive mechanism of hydrofoil device 110.

The drive platform includes support bar 134 to which are coupled two foot placement plates 162. In the embodiment of FIG. 8, support bar 134 includes two extension segments 136,137 which are releasably mounted in receive cavities 153,154, respectively, in center bar segment 138. The center bar segment may be of a length that is sufficient to securely mount plate 162. Bar segments 136,137 are respectively coupled through elbows 151,152 to vertical members 133, 135. The distal ends of vertical members 133,135 in turn releasably couple to drive foil 130. Drive foil 130 may be configured of multiple disassembleable pieces such as foil sections 171,172. By providing extension segments 136,137, the center segment may be limited in length to that which is needed to support foot plates 162, thereby rendering this portion of the drive platform compact. While support shaft 163 is releasably coupled in the embodiment of FIG. 9 (see below), the relatively narrow center segment 138 permits the support shaft to be fixedly coupled while still maintaining a relatively compact footprint.

Referring to FIG. 9, a perspective view of hydrofoil device 110 with another collapsible drive platform assembly in accordance with the present invention is shown. In FIG. 9, hydrofoil device 110 may have a canard 120, steering mechanism 140 and coupling support shaft 163 as discussed above with reference to FIG. 8. The drive platform 160, however, has an alternative configuration. In this embodiment, support bar 134 is formed in an extended configuration having an extended bar member 139 that releasably couples on one end to bar mounting section 155 and on the other end to bar mounting section 156. The bar mounting sections 155, 156 are respectively coupled through elbows 151, 152 to vertical members 133, 135 and further to foil 130 as discussed above.

FIG. 9 also illustrates that support shaft 163 may be releasably coupled to the drive platform 160. In one embodiment, this is achieve by way of a stub 173 extending from support bar 134 and being configured to snuggly fit inside the tubular structure of the support shaft. The stub and shaft may have aligned at holes 174, 175 through which a removable fastener 176 may be provided. Alternatively, stub 173 may include a protrusion pin that is biased outward that fits into hole 175, but may be depressed to release shaft 163.

Support shaft 163 is preferably releasably coupled to drive platform 160 in the embodiment of FIG. 9 because the extended bar member 139 is longer then center segment 138 (of FIG. 8) and, therefore, would be less compact than the embodiment of FIG. 8 if not decouplable. It should be recognized that while the embodiment of FIG. 8 illustrates a fixed coupling of shaft 163 to plate 160, this joint may be decouplable as illustrated in FIG. 9, etc.

FIGS. 10-12 illustrate features of the releasable assembly of hydrofoil device 110. FIG. 10 illustrates bar mounting section 155 having a longitudinal key or protrusion 157 that fits into a complementary recess located inside the tubular structure of extended bar member 139. These components preferably achieve a snug frictional fit. Bar segments 136, 137 preferably have a similar key that fits into a complementary recess in the tube structure of receive cavities 153, 154, respectively, or vice versa.

FIG. 11 illustrates releasable coupling of vertical member 133 to foil section 171. The end of vertical member 133 may include a mounting tab 181 that fits into a corresponding opening 183 in foil section 171. Foil section 171 is preferably sealed about opening 183 so that water does not enter the foil. A similar tab 182 and corresponding opening 184 are provided with vertical member 135 and foil section 172, respectively (see FIG. 9).

Vertical members 133, 135 are preferably made of a material such as aluminum, graphite, fiberglass or other material that has a some inherent elasticity, permitting the openings 183, 184 to be positioned inside of the non-flexed ends of the vertical members. The vertical members are then slightly flexed and their tabs respectively inserted into their corresponding openings. The tension or bias in the vertical members serves to positively couple the vertical members in the foil and thereby the keyed protrusions in their corresponding recesses.

FIG. 12 illustrates the assembly of drive foil 130 from multiple sections 171, 172. Section 172 may include an extension arm 191 having bias protrusions or pins 192 that are biased outward. Section 171 has a sleeve 193 with holes 194 formed therein. Arm 191 is preferably inserted into sleeve 193 such that pins 192 seat into holes 194, thereby securely holding the two sections of the drive foil together. Alternatively other releasable fastening means including screws and the like may be used to releasably couple the foil sections.

It should be recognized that the various releasable coupling schemes discussed above may be interchanged where appropriate and that various other releasable coupling mechanisms are known in the art and may be use as appropriate to releasably couple the various components of device 10.

Referring to FIGS. 8 and 9, it can be seen that the joint between foil section 171, 172 is approximately midway between the vertical members 133, 135. It can also be seen that for each half section the vertical member attaches at a location where roughly ⅓ of the foil section extends outward of its vertical member and ⅔ inward. Through empirical evidence it has been determined that this configuration puts low or no pressure on the joint region during driving thrusts, thereby lessening the structural impact on the joint region.

The embodiments discussed above may be, but are not necessarily, formed of the following materials. The foils may be formed of aluminum or graphite or fiberglass or another suitable material. The frame is preferably formed of aluminum or another suitable material. Frame components may be welded together or otherwise joined as appropriate and known. The bias mechanisms may include metal or composite springs, rubber or other elastic materials, etc. The handles may include rubber. Plastic may be provided on corners, edges and tube ends, etc., to smooth rough edges, provide seals or join components, etc. Various fabrication materials and techniques are known in the art.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A hydro foil device, comprising:

a first foil and a second foil, the second foil being a drive foil;

a support structure coupling the first foil and the drive foil and including a steering structure and a drive platform, the hydrofoil device being propelled forward in response to a driving force onto the drive platform that is transferred to the drive foil;

wherein the drive foil is releasably coupled to the drive platform; and wherein the drive foil is comprised of at least a first foil component and a second separate foil component that are releasably couplable to one another at a releasable joint to form the drive foil.

2. The device of claim 1, wherein the drive platform includes a horizontal support member from which descend first and second vertical members spacing the drive foil below the horizontal support member, the releasable joint being located between the first and second vertical members.

3. The device of claim 2, wherein horizontal support member supports a user foot placement region and the first and second vertical members are releasably coupled to the horizontal support member.

4. The device of claim 2, wherein the releasable joint is located approximately equi-distant between the first and second vertical members.

5. The device of claim 2, wherein the vertical members are coupled to the horizontal support member via a keyed protrusion and complimentary recess arrangement that achieves proper alignment of the drive foil when coupled to the distal end of the vertical members.

6. The device of claim 5, wherein the vertical members are coupled to the horizontal support member and the drive foil in a manner that biases the vertical members towards the horizontal support member.

7. The device of claim 2, wherein said horizontal support member includes a first, a center and a second section, the first section fixedly coupled to the first vertical member, the second section fixedly coupled to the second vertical member, the center section supporting a user foot placement region, and the first and second sections being releasably couplable to the center section.

8. The device of claim 2, wherein said horizontal support member supports a user foot placement region and extends substantially between the first and second vertical members which are releasably couplable thereto.

9. The device of claim 1, wherein the steering structure includes separate first and second steering shaft sections that are moveably coupled to one another, the second steering shaft sections having a first relative position at rest and moving to a second relative position in response to a driving force; and a bias mechanism for biasing the first and second steering shaft sections into the first relative position;

wherein the first and second shaft sections are coupled such that they are non-coaxially moveable with respect to one another in a first plane substantially in line with a direction of travel of the device and more rigid in a plane substantially perpendicular to the first plane.

10. The device of claim 1, wherein the first foil is forwardly located and the drive foil is rearwardly located.

11. The device of claim 1, wherein the first foil is releasably coupled to the steering structure.

12. A hydrofoil device, comprising:

a first foil and a second foil, the second foil being a drive foil;

a steering structure and a drive platform having a user foot placement region;

a support structure incorporating the steering structure and the drive platform and coupling the first foil to the drive foil, the hydrofoil device being propelled forward in response to a driving force onto the drive platform that is transferred to the drive foil; and a first vertical member and a second vertical member spacing the drive foil below the drive platform;

wherein the first and second vertical members are releasably coupled to the drive platform and releasably coupled to the drive foil; and wherein the drive foil is comprised of at least a first foil component and a second separate foil component that are releasably couplable to one another at a releasable joint.

13. The device of claim 12, wherein the first and second foil components are substantially equal length and approximately ⅓ of a given foil component extends beyond the vertical member to which the foil component is coupled.

14. A hydrofoil device, comprising:

a first foil and a second foil, the second foil being a drive foil;

a steering structure and a drive platform having a user foot placement region;

a support structure incorporating the steering structure and the drive platform and coupling the first foil to the drive foil, the hydrofoil device being propelled forward in response to a driving force onto the drive platform that is transferred to the drive foil; and a first vertical member and a second vertical member spacing the drive foil below the drive platform;

wherein the vertical members are releasably coupled to the drive platform via a keyed protrusion and complimentary recess arrangement that achieves proper alignment of the drive foil.

15. The device of claim 14, wherein the vertical members are biased towards the drive platform.

16. A hydrofoil device, comprising:

a first foil and a second foil, the second foil being a drive foil;

a support structure coupling the first foil and the drive foil and including a steering structure and a drive platform, the hydrofoil device being propelled forward in response to a driving force onto the drive platform that is transferred to the drive foil;

wherein the drive platform includes a horizontal support member from which descend first and second vertical members spacing the drive foil below the horizontal support member; and wherein said vertical members are releasably couplable to said horizontal support member and are configured in said drive platform in a manner that biases the vertical members towards the horizontal support member.

17. The device of claim 16, wherein the vertical members are releasably couplable to the drive foil.

18. The device of claim 17, wherein the drive foil is comprised of at least a first foil component and a second separate foil component that are releasably couplable to one another at a releasable joint.

19. The device of claim 17, wherein horizontal support member supports a user foot placement region.

* * * * *